US007063326B1

(12) United States Patent
Smart

(10) Patent No.: US 7,063,326 B1
(45) Date of Patent: Jun. 20, 2006

(54) ARCADE GAME AND METHOD OF MAKING, TRANSPORTING AND ASSEMBLING SAME

(75) Inventor: Jeffrey T. Smart, Altoona, IA (US)

(73) Assignee: Smart Industries Corporation, Des Moines, IA (US)

( * ) Notice: Subject to any disclaimer, the term of this patent is extended or adjusted under 35 U.S.C. 154(b) by 141 days.

(21) Appl. No.: 10/853,598

(22) Filed: May 24, 2004

(51) Int. Cl.
*A63B 7/36* (2006.01)

(52) U.S. Cl. ..... 273/447; 312/114

(58) Field of Classification Search ..... 273/440, 273/447, 448, 108; 312/114, 140, 265.1, 312/257.1, 138.1, 122–124
See application file for complete search history.

(56) References Cited

U.S. PATENT DOCUMENTS

| | | | | |
|---|---|---|---|---|
| 2,696,324 | A | 12/1954 | Jones | |
| 2,730,420 | A | 1/1956 | Bruck | |
| 4,243,282 | A | 1/1981 | Densen | |
| 5,271,628 | A | 12/1993 | Okada | |
| 5,549,372 | A | 8/1996 | Lewis | |
| 6,099,395 | A | 8/2000 | Guseman | |
| D459,759 | S | 7/2002 | Shepherd et al. | |
| 6,428,008 | B1 * | 8/2002 | Singer | 273/447 |
| 6,475,087 | B1 * | 11/2002 | Cole | 463/20 |
| 6,588,760 | B1 * | 7/2003 | Carter et al. | 273/448 |
| 2003/0090065 | A1 | 5/2003 | Carter, Jr. et al. | |
| 2003/0151202 | A1 * | 8/2003 | Fisher et al. | 273/447 |

* cited by examiner

*Primary Examiner*—Raleigh W. Chiu
(74) *Attorney, Agent, or Firm*—McKee, Voorhees & Sease, P.L.C.

(57) ABSTRACT

An arcade game cabinet is manufactured in separate front and back sections which are shipped separately and assembled at the point of use with each of the cabinet sections including preinstalled components thereby minimizing assembly steps during final assembly. The assembled cabinet displays oversized prizes on the back wall from the bottom wall to the top wall and prizes are stacked on the bottom wall visible through floor to top wall windows in each of the cabinet sections. A door in the front cabinet section allows for passage of a person into and out of the interior of the cabinet.

16 Claims, 4 Drawing Sheets

ARCADE GAME AND METHOD OF MAKING, TRANSPORTING AND ASSEMBLING SAME

BACKGROUND OF THE INVENTION

Arcade games have offered as prizes toys, candy and other small items for many years. Some stuffed animals when offered as a prize, being substantially larger permit only a few prizes to be displayed in a cabinet of conventional size due to their size and therefore require restocking the cabinet frequently.

A cabinet large enough to display an acceptable number of large prizes is too large to transport to the point of use. The oversize arcade game cabinet can be shipped in a totally disassembled condition but this requires a relatively high level of expertise on the part of the customer to assemble the machine for operation. The manufacturer can provide the assembly service but the cost can be substantial.

What is needed is an arcade game cabinet that can be easily manufactured, packaged, transported and easily assembled.

SUMMARY OF THE INVENTION

The arcade game of this invention involves a cabinet comprising a pair of front and back sections which are independently packaged and shipped to the point of use and can be readily assembled without special training by following simple intuitive instructions.

The oversized prizes on the order of 16×24 inches are displayed on gating extending over the substantial back wall of the cabinet. The stuffed animal prizes fill the cabinet from the floor upwardly and are visible through separate windows in the side walls of the cabinet extending between the top and bottom walls. The front wall of the front cabinet section includes a door having a window which extends a substantial height of the door. The door extends the substantial height of the cabinet and thus allows passage of a human into and out of a cabinet to assemble the cabinet, perform maintenance operations and fill with prizes.

The method of manufacturing, transporting and assembling the cabinet involves manufacturing cabinet half sections which are substantially preassembled such that the cabinet half sections need only be locked together, the boom assembly positioned on the front and back rods, and interconnecting the control harness in each of the cabinet half sections. Each cabinet half section has a rod running laterally near the top wall and closed wall such that the wheels on the boom assembly may support the trolley in moving side to side and front to back in the cabinet.

The prize storage and viewing area in the cabinet is maximized by the prizes being placed on the floor of the cabinet and visible through front and side wall windows extending between the floor and the top wall.

The cabinet half sections being separately packaged are of a size manageable for handling and when unpackaged at the site of use may be readily supported on caster wheels allowing them to be independently moved into position to be interconnected to create a unitary cabinet.

The preassembly of the cabinet half sections includes providing in the front cabinet section the prize box and control components while the back cabinet section includes the gating on the closed wall for display of prizes when the cabinet sections are assembled and locked together by cooperating male and female members on the walls of the cabinet half sections which are engaged to lock the cabinet sections together as a unitary cabinet.

DETAILED DESCRIPTION OF THE PREFERRED EMBODIMENT

Figure 1:
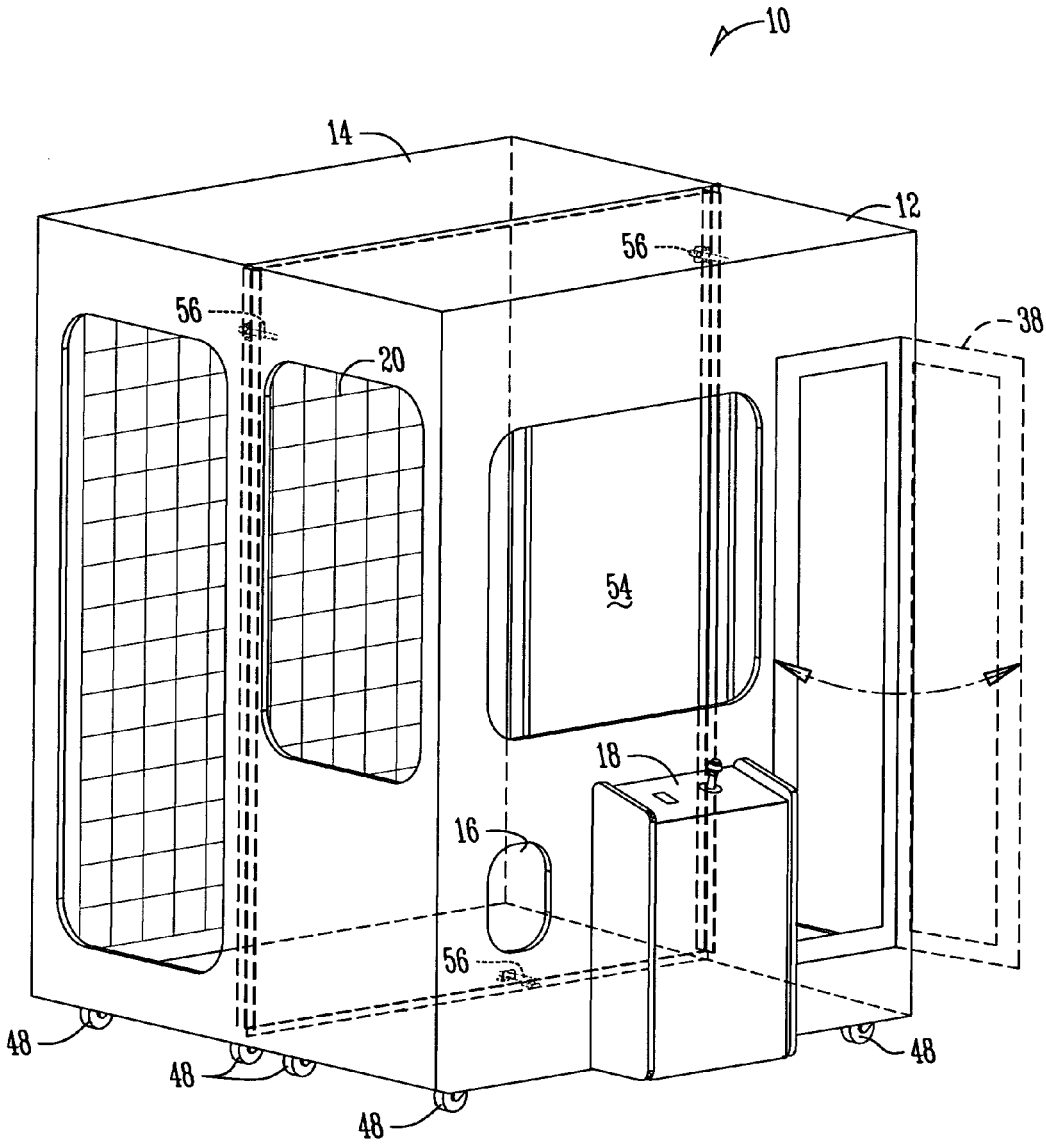
FIG. 1 is a front perspective view of the arcade game cabinet illustrating the front and back sections positioned to create a unitary cabinet.
Figure 2:
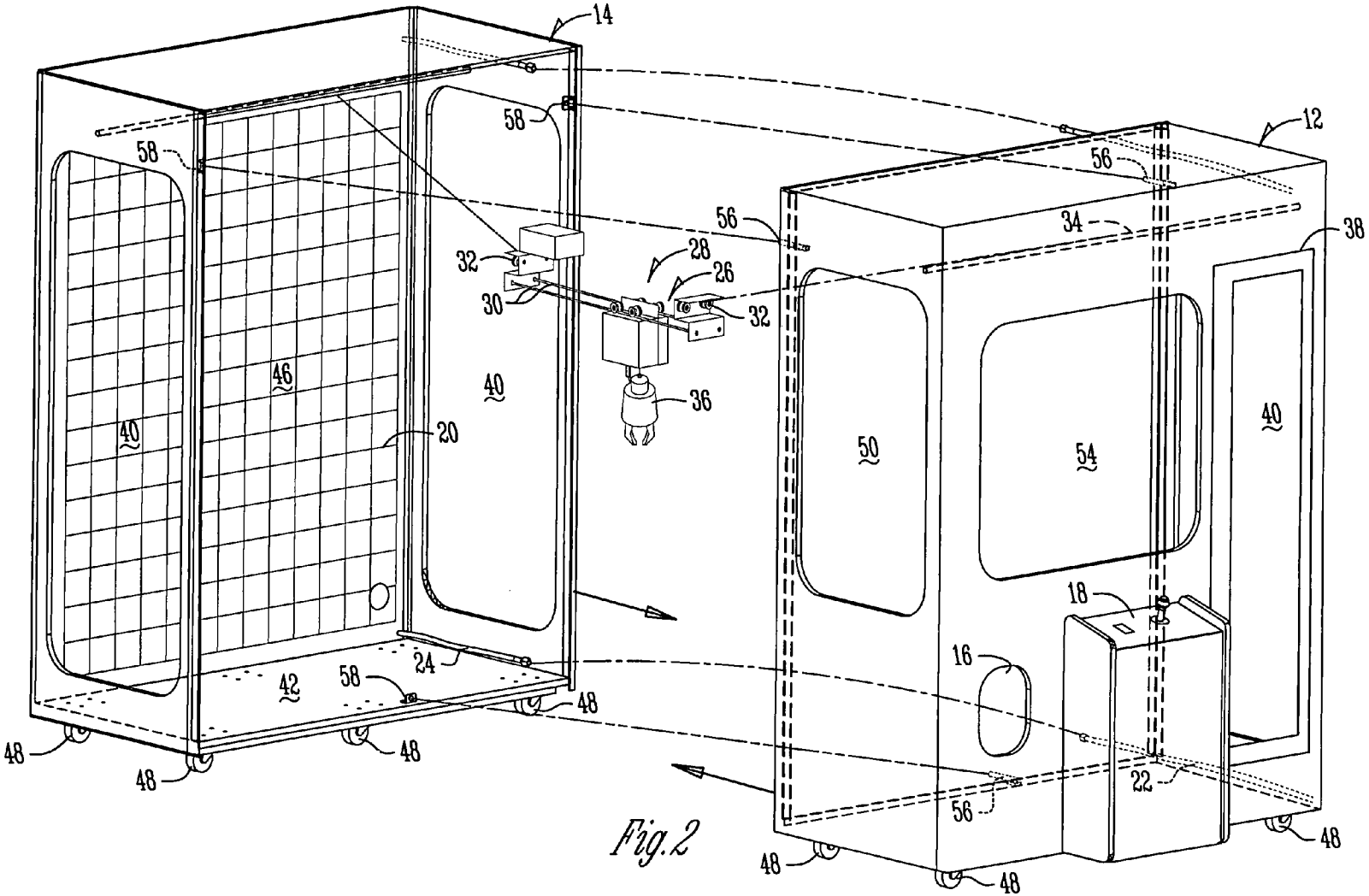
FIG. 2 is an exploded front perspective view showing the front and back cabinet sections spaced apart with the boom section which includes the trolley ready to be installed once the cabinet sections are locked together.

The arcade game cabinet of this invention is referred to generally in FIG. 1 by the reference numeral 10 and includes a front section 12 and a rear section 14.

The front and rear cabinet sections 12 and 14 are manufactured, packaged and shipped as free standing cabinet sections and include as many preassembled component parts as possible thereby requiring a minimum of time, effort and expertise at the point of use for final assembly.

The front section 12 includes a prize box 16 and a control console 18 while the rear cabinet section 14 includes display gating 20. Electrical control harness 22 in the front cabinet section 12 is adapted to be connected to control harness 24 in the back cabinet section 14.

A boom section 26 that is packaged separately includes a trolley unit 28 mounted moveable on boom rails 30 having rollers 32 at opposite ends for being supported on boom rods 34 in each of the front and back cabinet sections 12 and 14 such that a claw assembly 36 may move forwardly and rearwardly and from side to side within the cabinet. The front cabinet section 12 includes a door 38 extending the substantial height of the cabinet 10 which allows passage into and out of the cabinet by person for final assembly of the cabinet, maintenance, and restocking of the prizes. The door 38 also includes a full length window 40 which allows maximum viewing of the cabinet interior to see the prizes that may be won through operation of the arcade game. The right hand side of the front cabinet section includes a full length window similar to a window 40 or similar to a window 40 in the right hand side wall of the rear cabinet section 14. The opposite side wall of rear cabinet section 14 also includes a full size window 40. The back cabinet section 14 includes a bottom wall 42 and a top wall 44. A back wall 46 includes the display gating 20.

Casters 48 are provided on the bottom of each of the front and back cabinet sections 12 and 14 at each of the corners to allow the cabinet sections to be moved independently of each other into position for being locked together to form the unitary cabinet 10.

Figure 3:
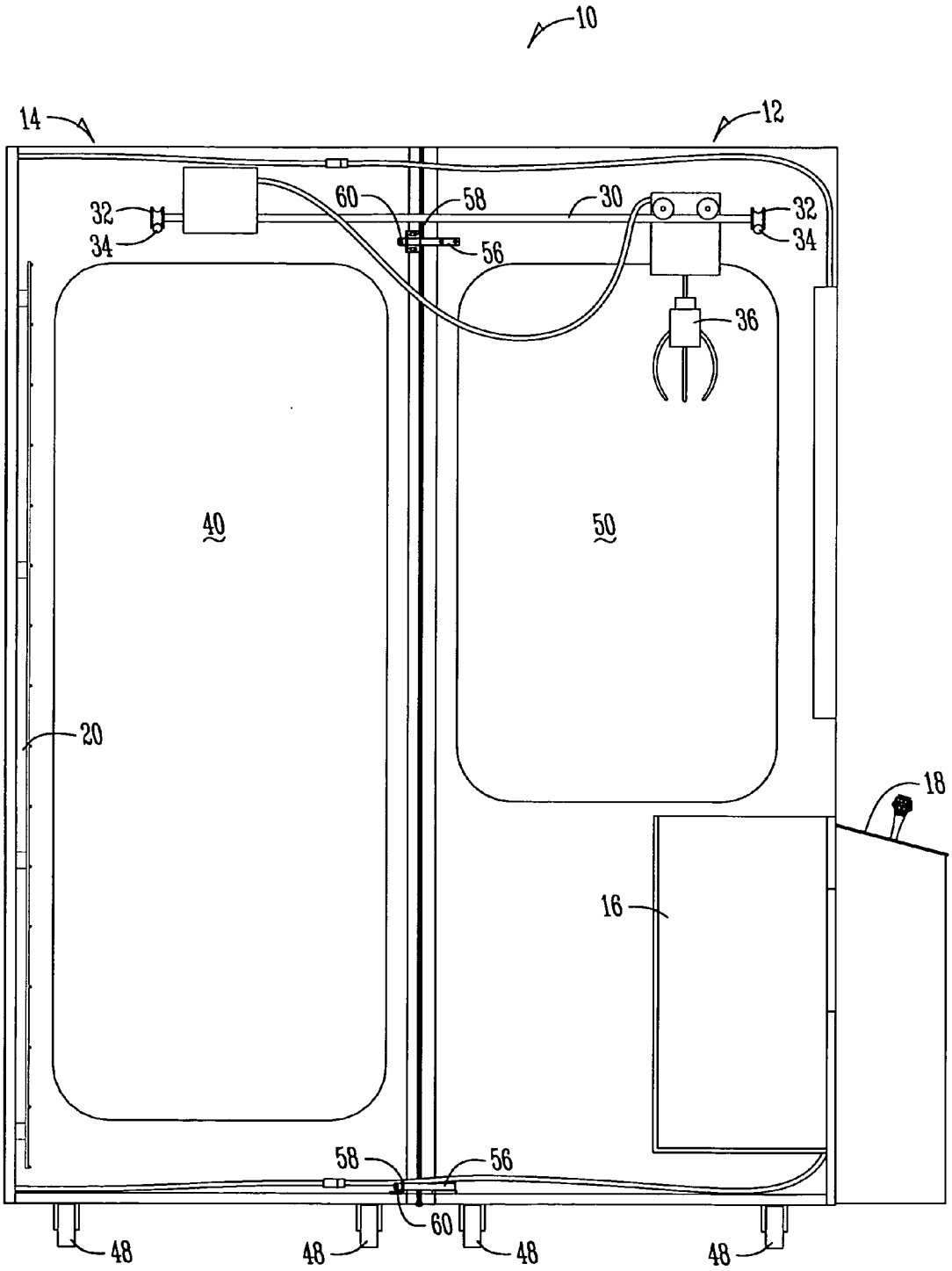
FIG. 3 is a side elevation view of the assembled cabinet showing the components in each of the front and back cabinet sections.

As seen in FIG. 3, a window 50 extends down to the prize box 16 in the left hand side wall of the front cabinet section 12.

Figure 4:
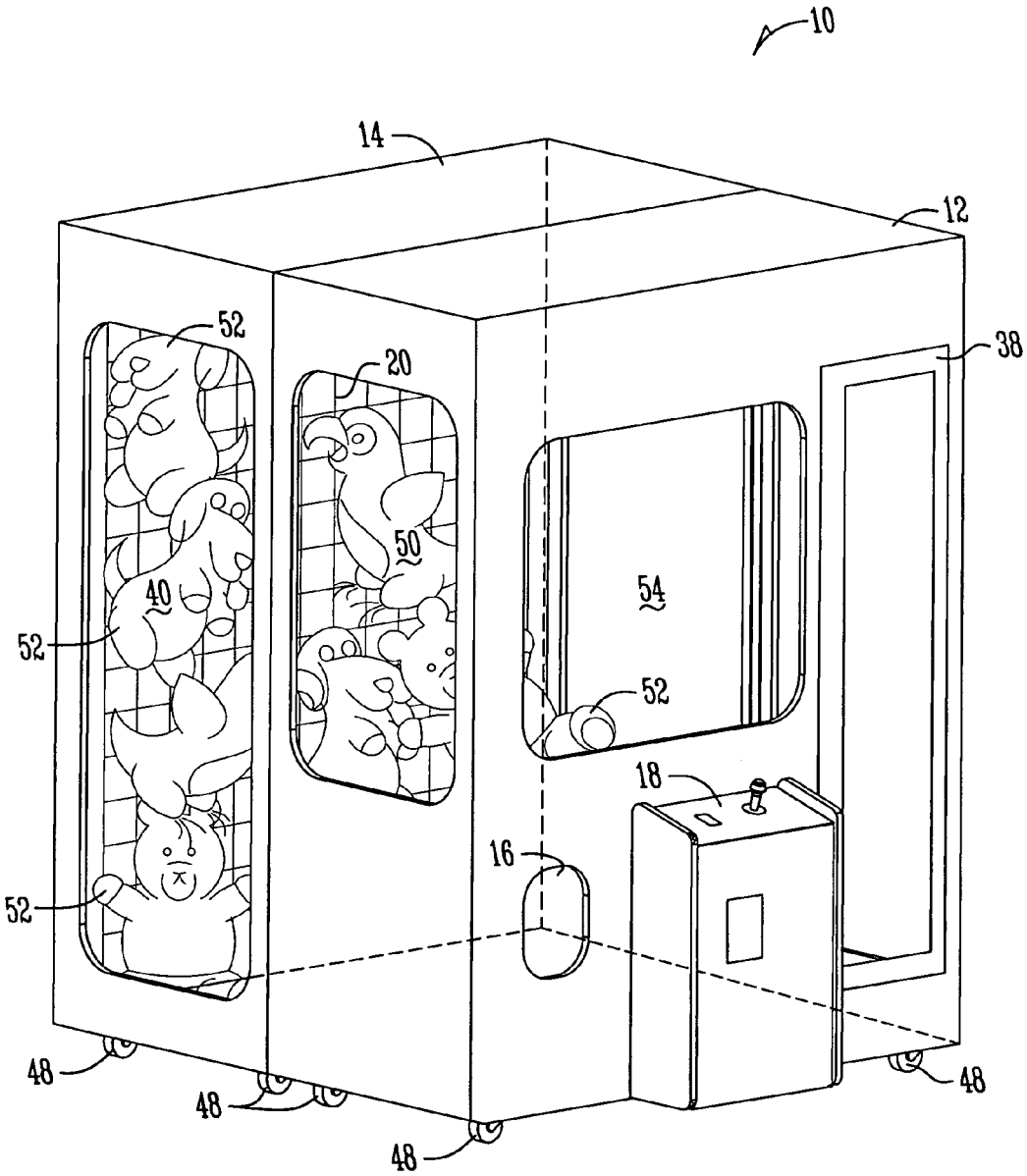
FIG. 4 is a front perspective view of the assembled cabinet containing oversized prizes displayed on back wall gating and filling the interior of the cabinet.

In FIG. 4, oversized stuffed animals 52 are mounted on the display gating 20 and stacked on the floor of the cabinet 10 for full viewing through the left hand side windows 40 and 50, the right hand windows 40, door window 40 and a front cabinet section wall window 54.

The cabinet half sections 12 and 14 are manufactured with most their component parts preassembled leaving only installation of the boom section assembly 26 at the point of use. The cabinet sections are unpackaged and are moved on their casters 48 into position for being locked together with their open sides facing each other. Male pins 56 are provided on the side walls of the front cabinet section 12 and are aligned to be received in female brackets 58 on the side walls of the rear cabinet section 14. A cotter pin 60 is inserted through the pin 56 to complete the locking assembly.

What is claimed is:

1. Method of assembly of an arcade game comprising the steps of:

providing front and back cabinet sections open on their facing sides and closed on their opposite sides, and a laterally extending rod in each of said front and back cabinet sections adjacent said closed sides;

providing a boom assembly having a pair of parallel rails with wheels at their opposite front and rear ends, and a moveable trolley on said rails;

positioning said front and back cabinet sections with their open sides facing each other;

locking said front and back sections together to provide an arcade game cabinet;

placing the wheels of either the front or rear ends of said parallel rails on one of said laterally extending rods; and placing the wheels of the other front or rear end of said rails on the other of said laterally extending rods whereby said boom assembly may be moved laterally on said rods and said trolley may be moved forwardly and rearwardly on said rails.

2. The method of assembly of an arcade game of claim 1 and the step of providing said front and back cabinet sections as half sections of substantially the same size in front to rear depth.

3. The method of assembly of an arcade game of claim 1 and the step of providing a prize box and controller in said front cabinet section and prize display gating in said back cabinet section.

4. The method of assembly of an arcade game of claim 1 and the step of providing wiring harness in each of said front and back cabinet sections and the step of interconnecting the wiring harness of each cabinet section upon said cabinet sections being locked together.

5. The method of assembly of an arcade game of claim 1 and the step of providing in said front and back cabinet sections a male locking member in one cabinet section and a female member in the other cabinet section and the step of inserting the male member in the female member during the step of locking said front and rear cabinet sections together.

6. The method of assembly of an arcade game of claim 1 and the steps of manufacturing and transporting including the step of packaging each of said front and back cabinet sections separately, the step of transporting the packaged front and back cabinet sections to a point of use, and the step of unpackaging each of said separate front and back cabinet sections.

7. The method of assembly of an arcade game of claim 6 and the step of providing rollers on the bottom of the front and back cabinet sections and wherein the step of positioning the front and back sections with their open sides facing each other includes positioning said sections by rolling on said roller said sections into position to be locked together.

8. An arcade game, comprising:

a cabinet having front and back sections open on their facing sides and closed on their opposite sides, and a laterally extending rod in each of said front and back cabinet sections adjacent said closed sides;

a boom assembly having a pair of parallel rails with wheels at their opposite front and rear ends, and a moveable trolley on said rails;

the wheels at opposite ends of said parallel rails being positioned on said laterally extending rods in each of said front and rear cabinet sections whereby said boom assembly may be moved laterally on said rods and said trolley may be moved forwardly and rearwardly on said rails; and a locking assembly having a male member on said front or back cabinet sections and a female member on the other of said front and back cabinet sections, said male and female members being engaged to lock said front and back cabinet sections together to provide a unitary arcade game cabinet.

9. The arcade game of claim 8 wherein said front and rear cabinet sections have top and bottom walls having edges along the open sides of said front and rear cabinet sections, said edges of said bottom walls engaging each other and said edges of said top walls engaging each other to provide cabinet top and bottom walls and a substantially open prize display area in the cabinet extending from the cabinet bottom wall to the cabinet top wall.

10. The arcade game of claim 9 wherein said closed wall of said front cabinet section includes a door substantially extending from the cabinet bottom wall to the cabinet top wall to provide for human passage into and out of said cabinet.

11. The arcade game of claim 9 and display gating is provided on the closed wall of the back cabinet section to hold and display prizes.

12. The arcade game of claim 11 wherein said display gating extends over the substantial area of said closed wall of said back cabinet section and from the cabinet bottom wall to the cabinet top wall.

13. The arcade game of claim 12 wherein said trolley includes claws moveable between raised and lowered positions with the lowered position being the bottom cabinet wall.

14. The arcade game of claim 13 wherein each of said front and back cabinet sections include oppositely disposed side walls which form cabinet side walls when said front and back cabinet sections are assembled to form said cabinet, and at least one of said cabinet side walls includes a window extending the substantial height of said cabinet between its top and bottom walls for viewing all prizes in the cabinet.

15. The arcade game of claim 14 wherein the side walls of each of said front and back cabinet sections include windows extending the substantial height of said cabinet between its top and bottom walls.

16. The arcade game of claim 15 wherein said door in said front cabinet section includes a window extending the substantial height of said door and cabinet.

* * * * *